US007017630B2

(12) United States Patent
Dikken

(10) Patent No.: US 7,017,630 B2
(45) Date of Patent: Mar. 28, 2006

(54) FUELING NOZZLE DEVICE

(75) Inventor: Mark P. Dikken, Brampton (CA)

(73) Assignee: Kardtech Incorporated, Brampton (CA)

( * ) Notice: Subject to any disclaimer, the term of this patent is extended or adjusted under 35 U.S.C. 154(b) by 57 days.

(21) Appl. No.: 10/805,318

(22) Filed: Mar. 22, 2004

(65) Prior Publication Data

US 2005/0082392 A1 Apr. 21, 2005

(30) Foreign Application Priority Data

Oct. 9, 2003 (CA) ..... 2444131

(51) Int. Cl.
*B65B 1/04* (2006.01)

(52) U.S. Cl. ..... 141/392; 141/386

(58) Field of Classification Search ..... 141/392, 141/98, 383–386, 206–226, 59
See application file for complete search history.

(56) References Cited

U.S. PATENT DOCUMENTS

| | | | | |
|---|---|---|---|---|
| 3,946,771 | A * | 3/1976 | Braun et al. | 141/59 |
| 4,913,201 | A * | 4/1990 | Lucero et al. | 141/334 |
| 5,236,023 | A * | 8/1993 | Mohr | 141/312 |
| 5,385,182 | A * | 1/1995 | Dyer | 141/392 |
| D403,573 | S | 1/1999 | Garvey, III | |

FOREIGN PATENT DOCUMENTS

EP 0566026 A1 10/1993

* cited by examiner

*Primary Examiner*—Steven O. Douglas
(74) *Attorney, Agent, or Firm*—Shoemaker and Mattare

(57) ABSTRACT

A device for use with a fueling nozzle including a handle assembly and a spout, the device includes a connection component for coupling to the fueling nozzle, proximal the spout, and a resilient member extending from the connection component. When in use, the connection component is coupled to the fueling nozzle and the resilient member extends into a fuel inlet of a vehicle along with the nozzle. The resilient member thereby biases the nozzle against a side of the fuel inlet.

18 Claims, 3 Drawing Sheets

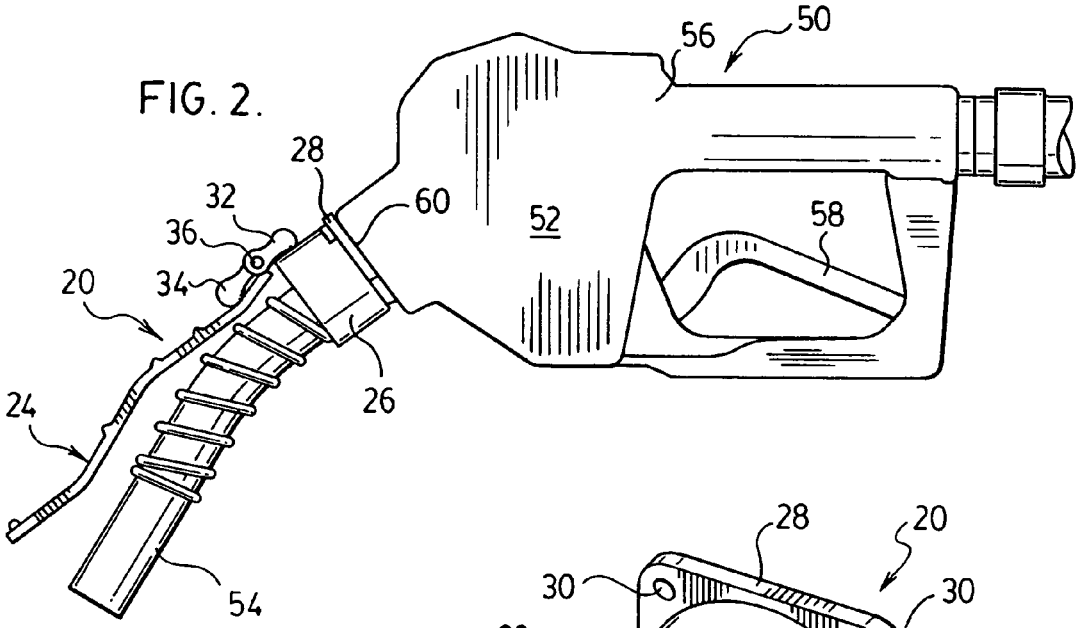
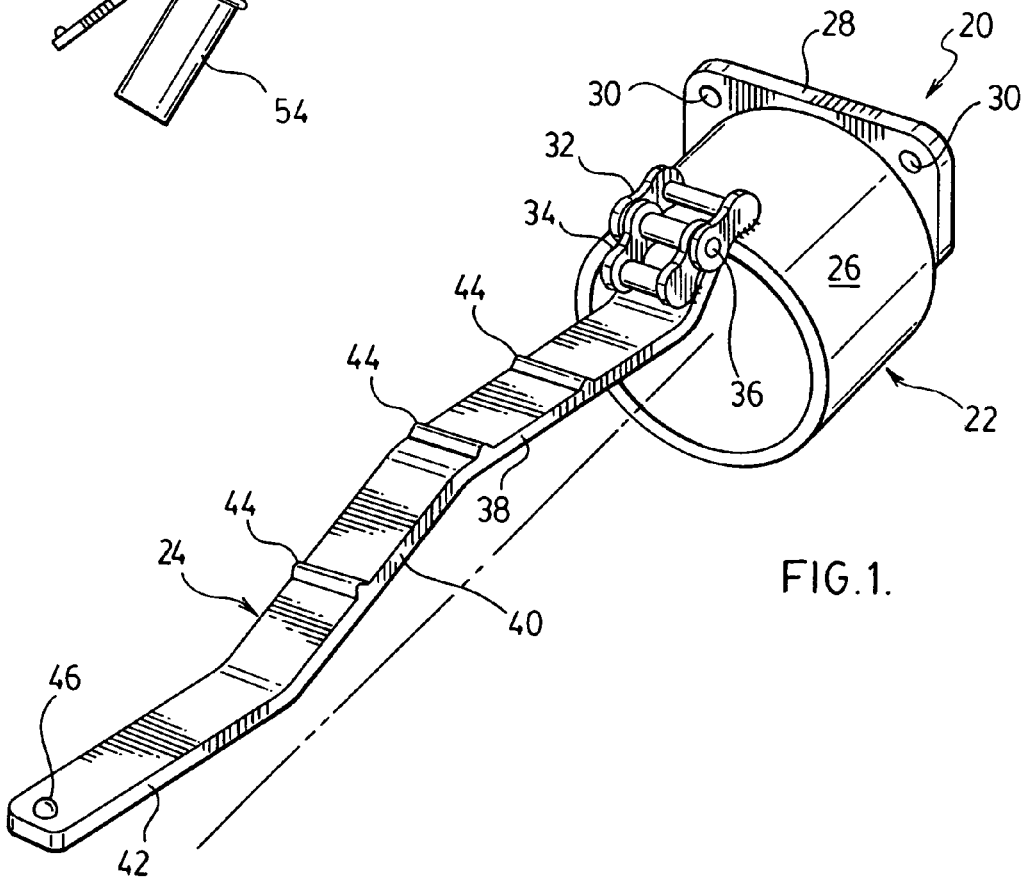
FIG. 1.

FUELING NOZZLE DEVICE

FIELD OF THE INVENTION

The present invention relates in general to fuel pump nozzles and more particularly to a device having structure for reducing the occurrence of fuel spills at fuel pumping stations, caused by nozzles that inadvertently fall from fuel inlets of vehicles, during fueling.

BACKGROUND OF THE INVENTION

Fuel spills that occur at automobile fueling stations are hazardous to the safety of individuals at or near the fueling station and to the environment. Fuel spills at fuel stations used by trucks in the trucking industry are common and in some cases, involve a large volume of fuel spilled. Clearly large volume fuel spills are extremely hazardous and can result in a loss of revenue.

Fuel spills at stations used in the trucking industry are generally the result of a nozzle being left unattended during pumping. Drivers commonly leave fuel nozzles unattended during filling due to the time required to fuel a large truck. In many cases, the fuel pump, the fuel line from the pump and the nozzle at the end of the fuel line are all in working order and have no defects. Thus, such spills are caused by other factors. For example, when fueling a truck, it is common for a driver to walk away from the truck or to attend to other matters around the truck. When left unattended, the spout portion of the nozzle then dislodges from the fuel inlet of the truck. This occurs for many reasons including, for example, due to accidental interference by the driver of the truck by inadvertently knocking or bumping the fuel line leading to the nozzle, due to wind that moves the fuel line and thereby moves the nozzle, due to changes in pressure that commonly occur at multi-fueling point stations or due to back pressure from the tank as the volume of fuel in the tank increases.

To reduce the occurrence of such spills at truck fueling sites, laws have been introduced requiring all persons fueling vehicles to be in attendance at the fueling point during fueling. Such laws however, are difficult to enforce.

To prevent persons from walking away from the pump during filling, hold-open clips that were present on the handle portion on 7H style nozzles in the past, are no longer available at truck fueling stations. These hold-open clips allow the driver to engage the clip to hold the trigger of the nozzle in the open position, without having to maintain hand contact with the trigger. The removal of these hold-open clips has not prevented drivers from leaving fuel pumps unattended during fueling, however. Foreign objects are commonly jammed into the handle of the nozzle to force the trigger into the open position and therefore allow the driver to leave the pump unattended during fueling.

Because, many drivers continue to walk away from the fueling point during fueling of their trucks, it is desirable to inhibit a nozzle from becoming dislodged from a fuel inlet of truck in the case that the fueling point is left unattended.

SUMMARY OF THE INVENTION

In one aspect of the present invention, there is provided a device for use with a fueling nozzle including a handle assembly and a spout, the device includes a connection component for coupling to the fueling nozzle, proximal the spout, and a resilient member extending from the connection component. When in use, the connection component is coupled to the fueling nozzle and the resilient member extends into a fuel inlet of a vehicle, along with the nozzle. The resilient member thereby biases the nozzle against a side of the fuel inlet.

In another aspect of the present invention, there is provided a fueling nozzle for use with a fuel pump and hose in fueling vehicles. The fueling nozzle includes a handle assembly including a handle portion having a fluid path in fluid communication with a hose from the pump, and a trigger in communication with the handle portion. The trigger is actuatable for causing fuel flow through the fluid path when in use. A spout extends from the handle portion. The spout is in fluid communication with the handle portion for flow of fuel from the hose through the handle portion and out the spout. A resilient member is coupled to one of the spout and the handle assembly and extends therefrom. When the nozzle is in use, the resilient member extends into the fuel inlet for abutting the fuel inlet and biasing the spout into contact with the fuel inlet.

Several advantages are realized in aspects of embodiments of the present invention. For example, the pump nozzle device provides an inexpensive way to aid in inhibiting nozzles from inadvertently falling from a fuel inlet of a vehicle. Also, the design permits use of the nozzle device with many different tank styles or different nozzles. Energy due to movement of the nozzle during filling is absorbed by the nozzle device. Other advantages also include improved grounding of the vehicle to the pump and reduced wear of the spout of the nozzle. Also, with the device in a non-use position, the device protects the plastic head cap at the top of the nozzle. If damaged, the head cap allows air in to the fuel tank and therefore does not provide a vacuum state in the tank. The vacuum state is desired in order for the automatic shut off on the fuel pump to work. Thus, protection of head cap is desirable.

BRIEF DESCRIPTION OF THE DRAWINGS

The invention will be better understood with reference to the drawings and the following description, in which:

FIG. 1 is a perspective view of a device for use with a fueling nozzle, showing a resilient member in a first position, according to an embodiment of the present invention;

FIG. 2 is a side view of the device of FIG. 1, installed on a nozzle, with the device in a use position;

DETAILED DESCRIPTION OF THE PREFERRED EMBODIMENTS

Figures 3, 4:
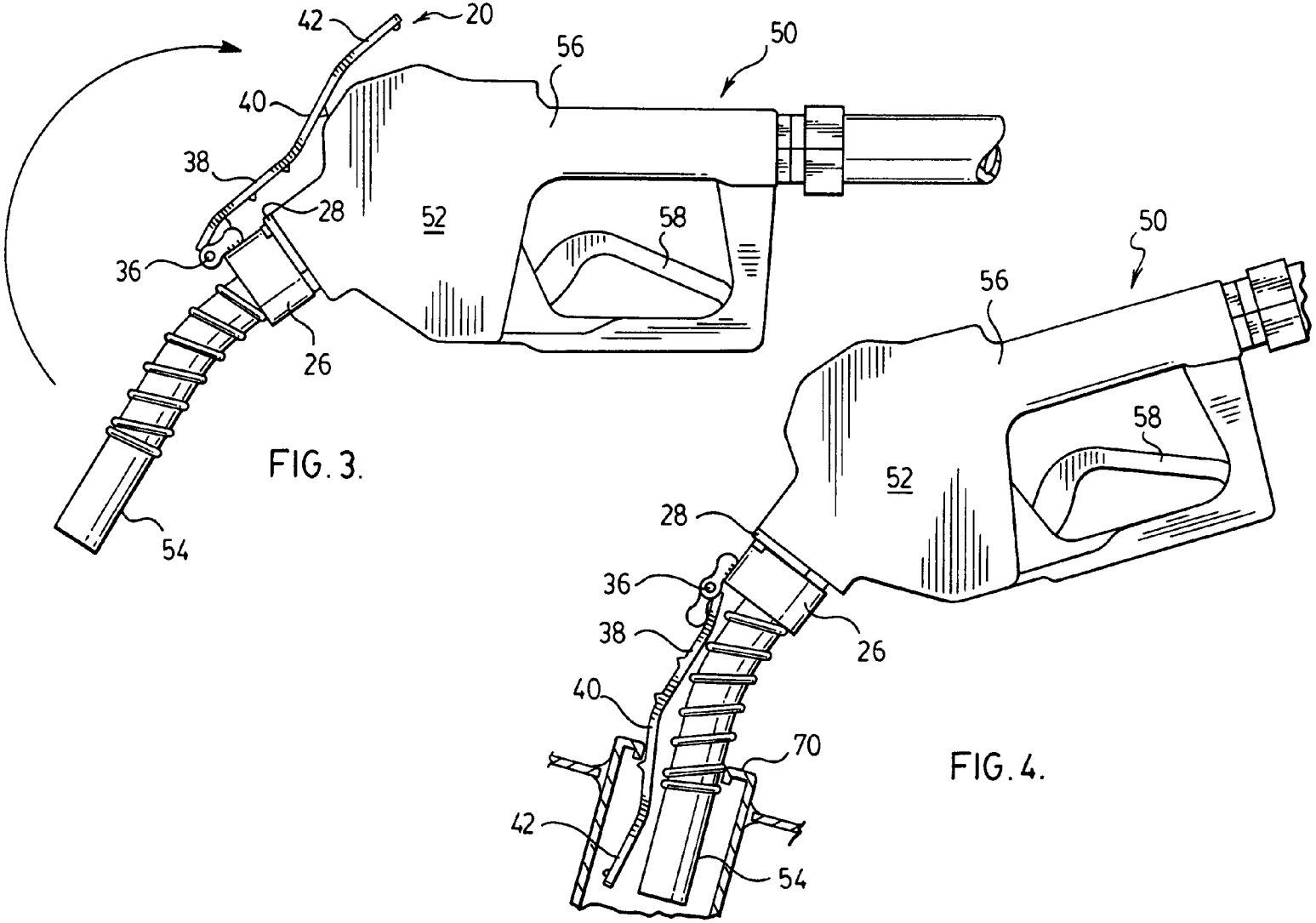
FIG. 3 is a side view of the device installed on the nozzle of FIG. 2, with the device in a non-use position.
FIG. 4 is a side view of the device installed on the nozzle of FIG. 2, with the device in the use position and the device and nozzle inserted into a fuel inlet, the fuel inlet shown in section.

Reference is first made to FIG. 1 to describe a device for use with a fueling nozzle (not shown in FIG. 1), the device being indicated generally by the numeral 20. The device 20 includes a connection component 22 for coupling to the fueling nozzle, proximal a spout thereof. The device 20 also includes a resilient member 24 extending from the connection component 22. When in use, the connection component 22 is coupled to the fueling nozzle and the resilient member 24 extends into a fuel inlet of a vehicle (not shown), along with the nozzle. The resilient member 24 thereby biases the nozzle against a side of the fuel inlet.

The device 20 will now be described in more detail. As shown in FIG. 1, the device 20 includes the connection component 22 that has a collar 26 and a mounting plate 28. The collar 26 is generally cylindrically shaped and is sized to fit snugly around a standard spout of a fueling nozzle. The mounting plate 28 is welded to and extends outwardly from a portion of one end of the collar 26. The mounting plate 28 includes a pair of bolt holes 32 that are sized and spaced to match a bolt pattern on a face of the nozzle that is near the junction between the spout and a handle assembly of the nozzle. Clearly the bolt holes 30 in the mounting plate 28 are used for mounting the device 20 to the nozzle.

The device 20 also includes the resilient member 24 that extends from the collar 26. The resilient member 26 is fixed to the collar 26 via first and second chain linkages 32, 34, respectively. The first chain linkage 32 is welded to the collar 26 and the second chain linkage 34 welded to the resilient member 26. Clearly the first and second chain linkages 32, 34, respectively are coupled to each other and hinge about an axis 36. Thus, the resilient member 24 is fixed to the collar 26 and is movable between a first position that is best shown in FIG. 2 and a second position that is best shown in FIG. 3.

Rather than extending straight from the collar 26, the resilient member 24 includes a number of bends therein. In the present embodiment, the resilient member 24 includes first second and third sections 38, 40, 42, respectively. As best shown in FIG. 1, the first and third sections 38, 42, respectively are generally parallel and a separated by the second section 40 that extends therebetween. Clearly the second section 40 extends at an obtuse angle to both the first and third sections 38, 42, respectively.

Each of the first and second sections 38, 40, respectively, include ribs 44 that protrude from the resilient member 24 and extend across the width thereof. A rounded bump 46 protrudes from the third section 42 of the resilient member, proximal an end thereof. The use and function of the ribs 44 and rounded bump 46 will be more fully explained below.

In the present embodiment, all portions of the device 20 are made of stainless steel that is TIG welded and the resilient member is tempered. Other suitable materials and manufacturing methods are possible.

Referring now to FIGS. 2 and 3, perspective views of the device 20 installed on a nozzle are shown. The nozzle is indicated generally by the numeral 50. As shown, the nozzle 50 includes a handle assembly 52 for connection at one end to a fuel line hose, and a spout 54 connected to a second end of the handle assembly 52. The handle assembly 52 has a handle portion 56 for grasping during pumping, through which a fluid path is provided. The fluid path connects the fuel line hose and the spout 54 in fluid communication. A trigger 58 is connected to the handle portion 56 and operates a valve in the fluid path for controlling fuel flow through the fluid path. As will be appreciated, the trigger 58 is actuated during fueling to cause fuel flow through the fluid path and out the spout 54.

Referring still to FIGS. 2 and 3, the device 20 is connected to the nozzle 50 by sliding the spout 54 through the collar 26 and then moving the collar 26 up the spout 54. Next, connecting bolts (not shown) are located through the bolt holes 30 of the mounting plate 28 and into bolt holes on a face 60 of the nozzle 50 that is near the junction between the spout 54 and the handle assembly 52. As previously indicated, the bolt holes 32 through the mounting plate 28 are sized and spaced to match the bolt pattern on the face 60, providing a convenient attachment for the device 20 on the nozzle 50.

As described above, the resilient member 24 is movable by hinging about the chain linkages 32, 34, between a first position, also referred to as a use position (shown in FIG. 2) and a second position, referred to as a non-use position (shown in FIG. 3). When in the use position, the resilient member 24 extends generally in the direction of the spout 54, although clearly the resilient member 24 does not follow the exact contour and direction of the spout 45. When in the non-use position, the resilient member 24 extends away from the spout, such that the resilient member 24 abuts the handle portion 56, as shown in FIG. 3.

Figure 5:
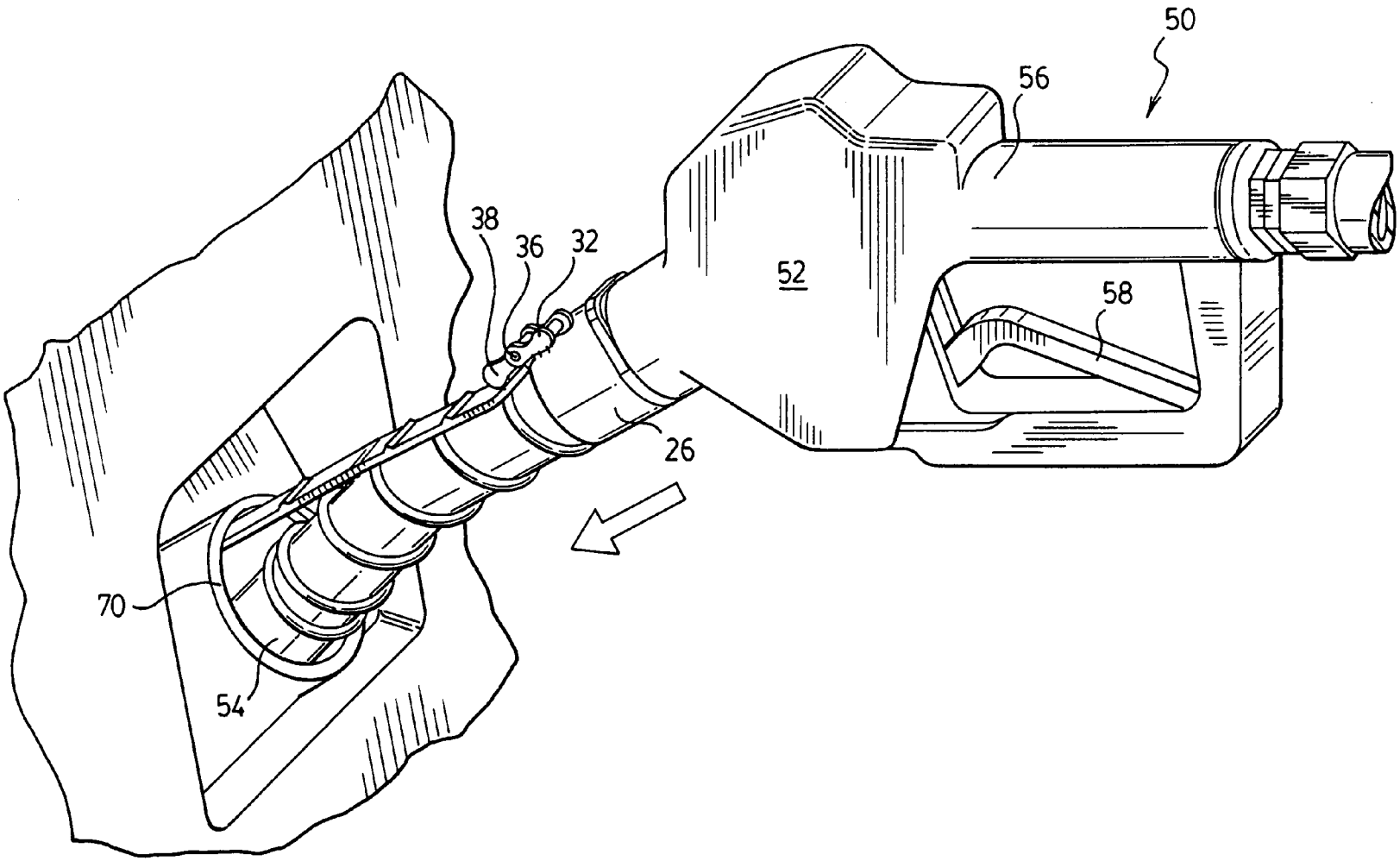
FIG. 5 is a perspective view of the device installed on the nozzle of FIG. 4, with the nozzle device in a use position and the device and nozzle inserted into a fuel inlet.

In use during fueling, the resilient member 24 is placed in the use position and both the spout 54 and the resilient member 24 are urged into a fuel inlet 70 of a vehicle, as best shown in FIGS. 4 and 5. Due to the limited size of the fuel inlet 70, the resilient member 24 abuts a sidewall of the fuel inlet 70 and thereby acts to spring bias the spout 54 into contact with the sidewall of the fuel inlet 70. It will be understood that the bends that are provided in the resilient member 24 aid in spring biasing the spout 54 against the sidewall of the fuel inlet. Thus, friction between the spout 54 and the sidewall of the fuel inlet 70 and between the resilient member 24 and the sidewall of the fuel inlet 70 aids in inhibiting the spout 54 from inadvertently falling out of the fuel inlet 70 during fueling.

As previously explained, the resilient member 24 has ribs 44 that protrude and extend across the width thereof. These ribs 44 and the rounded bump 46 further aid in inhibiting the spout 54 from inadvertently falling out of the fuel inlet 70 as they protrude from the resilient member 42 and provide locations of increased resistance to removal of the spout 54 and the resilient member 24 from the fuel inlet 70. The third section 42 of the resilient member 24 also has a rounded bump 46 near an end thereof for screened tanks. This rounded bump 46 sits in the screen orifice when in use. Thus, the resilient member 24 contacts the fuel inlet and thereby provides electrical contact for grounding.

Once the spout 54 and the resilient member 24 are placed in the fuel inlet 70 of the vehicle, the vehicle is then refueled. To remove the spout 54 and the resilient member 24, the handle portion 56 of the nozzle 50 is grasped and pulled outwardly and away from the fuel inlet 70.

In the event that the fuel inlet 70 is not large enough to accommodate both the spout 54 and the resilient member 24, or the vehicle design does not permit both the spout 54 and the resilient member 24 to be inserted into the fuel inlet 70, the resilient member 24 is moved to the non-use position and fueling then begins. In the non-use position, the resilient member 24 does not inhibit the spout 54 from inadvertently falling out of the fuel inlet 70. In this case, however, the resilient member provides protection for part of the handle assembly 52.

The many features and advantages of the present invention will be apparent from the above description. Since numerous modifications and changes may occur to those skilled in the art, it is not desired to limit the invention to the exact construction and operation illustrated and described herein. Accordingly, such modifications and changes are believed to be within the scope and sphere of the present invention.

What is claimed is:

1. A device for use with a fueling nozzle comprising a handle assembly and a spout, the device comprising:

a connection component for coupling to said fueling nozzle, proximal said spout; and a resilient member extending from said connection component, said resilient member comprising a beam having a plurality of bends at locations spaced from said connection component, said connection component for coupling to said fueling nozzle and said resilient member for extending into a fuel inlet of a vehicle with said nozzle, thereby biasing said nozzle against a side of said fuel inlet.

2. The device according to claim 1, wherein said resilient member is hingedly attached to said connection component for moving said resilient member between a use position and a non-use position.

3. A device for use with a fueling nozzle comprising a handle assembly and a spout, the device comprising:

a connection component for coupling to said fueling nozzle, proximal said spout; and a resilient member extending from said connection component, said connection component for coupling to said fueling nozzle and said resilient member for extending into a fuel inlet of a vehicle with said nozzle, thereby biasing said nozzle against a side of said fuel inlet, wherein said beam comprises a plurality of ribs extending along a surface of said beam, transverse to a length of said beam.

4. The device according to claim 1, wherein said connection component comprises a mounting plate for mounting to the nozzle.

5. The device according to claim 4, wherein said connection component further, said mounting plate being fixed to one end thereof.

6. The device according to claim 1, wherein said connection component comprises a collar disposed on the spout.

7. A fueling nozzle for use with a fuel pump and hose in fueling vehicles, the fueling nozzle comprising:

a handle assembly comprising a handle portion having a fluid path in fluid communication with a hose from said pump, and a trigger in communication with said handle portion, the trigger being atutaable for causing fuel flow through said fluid path when in use;

a spout extending from said handle portion, said spout in fluid communication with said handle portion for flow of fuel from said hose through said handle portion and out said spout; and a resilient member coupled to a least one of said spout and said handle assembly and extending therefrom, said resilient member comprising a beam having a plurality of bends at locations spaced from said handle portion, whereby when said nozzle is in use, said resilient member extends into said fuel inlet for abutting said fuel inlet and biasing said spout into contact with said fuel inlet.

8. The fueling nozzle according to claim 7, wherein said resilient member is coupled to said spout, proximal said handle assembly.

9. A fueling nozzle for use with a fuel pump and hose in fueling vehicles, the fueling nozzle comprising:

a handle assembly comprising a handle portion having a fluid path in fluid communication with a hose from said pump, and a trigger in communication with said handle portion, the trigger being actutaable for causing fuel flow through said fluid path when in use;

a spout extending from said handle portion, said spout in fluid communication with said handle portion for flow of fuel from said hose through said handle portion and out said spout; and a resilient member coupled to a portion of said handle assembly and extending therefrom, said resilient member for extending into said fuel inlet for abutting said fuel inlet and biasing said spout into contact with said fuel inlet.

10. The fueling nozzle according to claim 7, wherein said resilient member is hingedly coupled to said spout for moving said resilient member between a use position and a non-use position.

11. The fueling nozzle according to claim 9, wherein said resilient member is hingedly coupled to said portion of said handle assembly for moving said resilient member between a use position and a non-use position.

12. The fueling nozzle according to claim 7, wherein said resilient member is coupled to said spout via a connection component mounted on said spout, said resilient member extending from said connection component.

13. The fueling nozzle according to claim 9, wherein said resilient member is hingedly attached to said connection component for moving said resilient member between a use position and a non-use position.

14. The fueling nozzle according to claim 9, wherein said resilient member comprises a beam.

15. The fueling nozzle according to claim 14, wherein said beam comprises a plurality of ribs extending a long a surface thereof, transverse to a length thereof.

16. The fueling nozzle according to claim 12, wherein said connection component comprises a mounting plate for mounting to the nozzle.

17. The fueling nozzle according to claim 16, wherein said connection component further comprises a collar, said mounting plate being fixed to one end thereof.

18. The fueling nozzle according to claim 12, wherein said connection component comprises a collar disposed on the spout.

* * * * *